US008917216B2

(12) United States Patent
Miyoshi et al.

(10) Patent No.: US 8,917,216 B2
(45) Date of Patent: Dec. 23, 2014

(54) ANTENNA DEVICE WITH U-SHAPED SLIT

(71) Applicants: Akira Miyoshi, Tokyo (JP); Akihiro Oshima, Tokyo (JP); Yoshiaki Imano, Tokyo (JP)

(72) Inventors: Akira Miyoshi, Tokyo (JP); Akihiro Oshima, Tokyo (JP); Yoshiaki Imano, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 208 days.

(21) Appl. No.: 13/719,455

(22) Filed: Dec. 19, 2012

(65) Prior Publication Data

US 2013/0169496 A1 Jul. 4, 2013

(30) Foreign Application Priority Data

Dec. 28, 2011 (JP) ..... 2011-287556

(51) Int. Cl.
*H01Q 13/16* (2006.01)

(52) U.S. Cl.
CPC ..... *H01Q 13/16* (2013.01)
USPC ..... 343/767

(58) Field of Classification Search
CPC ..... H01Q 13/16; H01Q 13/10
USPC ..... 343/767
See application file for complete search history.

(56) References Cited

U.S. PATENT DOCUMENTS

| | | | | |
|---|---|---|---|---|
| 5,914,693 | A * | 6/1999 | Takei et al. | 343/767 |
| 6,917,333 | B2 | 7/2005 | Ikegaya et al. | |
| 7,318,268 | B2 | 1/2008 | Ikegaya et al. | |
| 8,130,158 | B2 * | 3/2012 | Kurashima et al. | 343/741 |
| 8,593,352 | B2 * | 11/2013 | Tseng et al. | 343/702 |
| 2012/0105303 | A1 | 5/2012 | Kusanagi | |

FOREIGN PATENT DOCUMENTS

| | | | |
|---|---|---|---|
| JP | 2003-152429 | A | 5/2003 |
| JP | 2011-19178 | A | 1/2011 |
| JP | 4780352 | B2 | 9/2011 |

* cited by examiner

*Primary Examiner* — Hoang V Nguyen
(74) *Attorney, Agent, or Firm* — Holtz, Holtz, Goodman & Chick PC

(57) ABSTRACT

An antenna device includes a feeding line having a first conductor and a second conductor and an antenna element having a conductive flat plate in which a slit is formed. The conductive flat plate has first and second sides opposite to each other and a third side. The antenna element is divided into an antenna pattern portion and a ground pattern portion via the slit. The slit is configured with a first slit portion apart from a center line towards the first side, a second slit portion apart from the center line towards the second side, a third slit portion coupling the first slit portion with the second slip portion, and a cutting portion coupling the third slit portion with the third side.

7 Claims, 4 Drawing Sheets

Radiation Efficiency

| | Unit | 2.412 GHz | 2.442 GHz | 2.472 GHz |
|---|---|---|---|---|
| 10A | (%) | 28.9 | 30.7 | 29.7 |
| | (dB) | −5.4 | −5.1 | −5.3 |
| 10 | (%) | 26.8 | 28.8 | 27.9 |
| | (dB) | −5.7 | −5.4 | −5.5 |

ANTENNA DEVICE WITH U-SHAPED SLIT

This application is based upon and claims the benefit of priority from Japanese patent application No. 2011-287556, filed on Dec. 28, 2011, the disclosure of which is incorporated herein its entirety by reference.

BACKGROUND OF THE INVENTION

This invention relates to an antenna device and, more particular, to an antenna device for use in a frequency band of a wireless Local Area Network (LAN).

In the manner which is well known in the art, the wireless LAN is an LAN using a transmission path except for a wired cable, such as electric waves, infrared rays, or the like.

Standardization of the wireless LAN is developed in IEEE (Institute of Electrical and Electronics Engineers) 802.11 Committee. That is, the IEEE 802.11 Committee develops specifications of the standard of the wireless LAN.

For example, IEEE 802.11a is a specification of a high-speed wireless LAN and a wireless access for 5 GHz band where the IEEE 802.11 Committee develops. A communication rate (a transfer rate) is about 20 Mbits/sec to 50 M bits/sec. A CSMA/CD (carrier sense multiple access with collision detection) is used as an MAC (media access control). A modulation method of a physical layer is an OFDM (orthogonal frequency division multiplex).

On the other hand, IEEE 802.11b is a specification of the wireless LAN where the IEEE 802.11 Committee standardizes in September, 1999. The IEEE 802.11b uses frequencies of 2.4 GHz band and uses a direct spread (DS) as a modulation method. A transmission rate (a transfer rate) is 11 Mbits/sec or 5.5 Mbits/sec.

Furthermore, IEEE 802.11g is one of standards for the wireless LAN where the IEEE 802.11 Committee develops in June, 2003 and a specification for carrying out communications about 54 Mbits/sec at 2.4 GHz band. The OFDM is used as a modulation method. Accordingly, the IEEE 802.11g uses the frequencies of 2.4 GHz band which is similar to that of the IEEE 802.11b and supports the transfer rate of 54 Megabits/sec which is about five times of that of the IEEE 802.11b. In contrast to the IEEE 802.11a for supporting the transfer rate of 54 Mbits/sec, the IEEE 802.11g maintains compatibility with the IEEE 802.11b. In addition, although a maximum transfer rate of 54 Mbits/sec is similar to that of the IEEE 802.11a. the 2.4 GHz band is a "busy" frequency band where a lot of equipments except for the wireless LAN use. Therefore, it is said that a real transfer rate in the IEEE 802.11g becomes later than that of the IEEE 802.11a.

Inasmuch as the IEEE 802.11b and the IEEE 802.11g use the same use frequency band of 2.4 GHz band in the manner which is described above, both are collectively called IEEE 802.11b/g herein.

Various antenna devices used in the frequency band of the wireless LAN are already known in the art.

By way of example, JP 2003-152429 A (which will later be called Patent Document 1 and which corresponds to U.S. Pat. No. 6,917,333 B2) discloses a flat-plate antenna device capable of stably exhibiting desired antenna characteristics. The flat-plate antenna disclosed in Patent Document 1 comprises a conductive flat plate and a power supply line (a feeding line). The conductive flat plate has a slit portion with a width proportional to a frequency band width and comprises a radiating element portion disposed on one side of the slit portion and a ground portion disposed on the other side of the slit portion. The power supply line (the feeding line) has a first conductor directly connected to the radiating element portion and a second conductor directly connected to the ground portion. Length of the radiating element portion contributes to resonance frequency, width of the slit portion contributes to frequency band, and ratio between length of the conductive flat plate and width of the ground portion contributes to directivity.

In addition, JP 4,780,352 B (which will later be called Patent Document 2) discloses an inexpensive antenna device (a sheet plate antenna) which is capable of easily assembling and of improving mounting strength for a coaxial cable. The antenna device disclosed in Patent Document 2 comprises an antenna device which is capable of transmitting and receiving a radio wave having a desired frequency band of 2.4 GHz band and which comprises the coaxial cable having a center conductor, an external conductor, and a sheath covering the external conductor, and an antenna element. The antenna element is made of a metallic plate which comprises an antenna pattern portion configured with an inverted-F antenna and a ground portion formed integrally with the antenna pattern portion. The metallic plate is, for example, formed from phosphor bronze. The coaxial cable is swaged and fixed to the ground portion and the center conductor of the coaxial cable is connected to a feeding portion of the inverted-F antenna.

Furthermore, JP 2011-19178 A (which will later be called Patent Document 3 and which corresponds to US Publication 2012/0105303 A1) discloses an antenna device (a board antenna) which is capable of easily soldering an external conductor of a coaxial cable to a ground pattern portion. The antenna device disclosed in Patent Document 3 comprises an antenna device which is capable of transmitting and receiving a radio wave having a desired frequency band of 2.4 GHz band and which comprises the coaxial cable having a center conductor and an external conductor and an antenna element. The antenna element comprises an antenna pattern portion and a ground pattern portion. The center conductor of the coaxial cable is electrically connected to a first solder portion of the antenna pattern portion by soldering while the external conductor of the coaxial cable is electrically connected to a second solder portion of the ground pattern portion by soldering. The ground pattern portion has, in vicinity of the second solder portion, a ground pattern opening portion defining the second solder portion. The second solder portion is sandwiched between the first solder portion and the ground pattern opening portion.

However, inasmuch as each of the antenna devices disclosed in the above-mentioned Patent Documents 1-3 is configured so that the radiating element portion (the antenna pattern portion) comprises the inverted-F antenna, they are disadvantageous in that a frequency band of a transmittable/receivable radio wave (radio signal) is narrow and radiation efficiency is also not excellent. In a case where the frequency band is narrow, on producing the antenna devices in quantity, problem arises when a frequency drift occurs. As a result, it reduces yields of quantity production.

SUMMARY OF THE INVENTION

It is therefore an exemplary object of the present invention to provide an antenna device which has a wide frequency band of a transmittable/receivable radio wave (radio signal) and excellent radiation efficiency.

Other objects of this invention will become clear as the description proceeds.

According to an exemplary aspect of this invention, an antenna device comprises a feeding line including a first conductor and a second conductor, and an antenna element comprising a conductive flat plate in which a slot is formed. The antenna element is divided into an antenna pattern portion and a ground pattern portion via said slit. The first conductor of the feeding line is connected to the antenna pattern portion while the second conductor of the feeding line is connected to the ground pattern portion. The conductive flat plate has first and second sides opposite to each other in a state where a center line extending in a predetermined direction is sandwiched therebetween, and a third side connecting the first and the second sides. The slit is configured with a first slit portion disposed so as to apart from the center line toward the first side by a first predetermined spacing, a second slit portion disposed so as to apart from the center line toward the second side by a second predetermined spacing, a third slit portion coupling the first slit portion with the second slit portion, and a cutting portion coupling the third slit portion with the third side.

DETAILED DESCRIPTION OF EXEMPLARY EMBODIMENTS

Before describing of the present invention, the related art will be explained in detail with reference to FIG. 1 in order to facilitate the understanding of the present invention.

Figure 1:
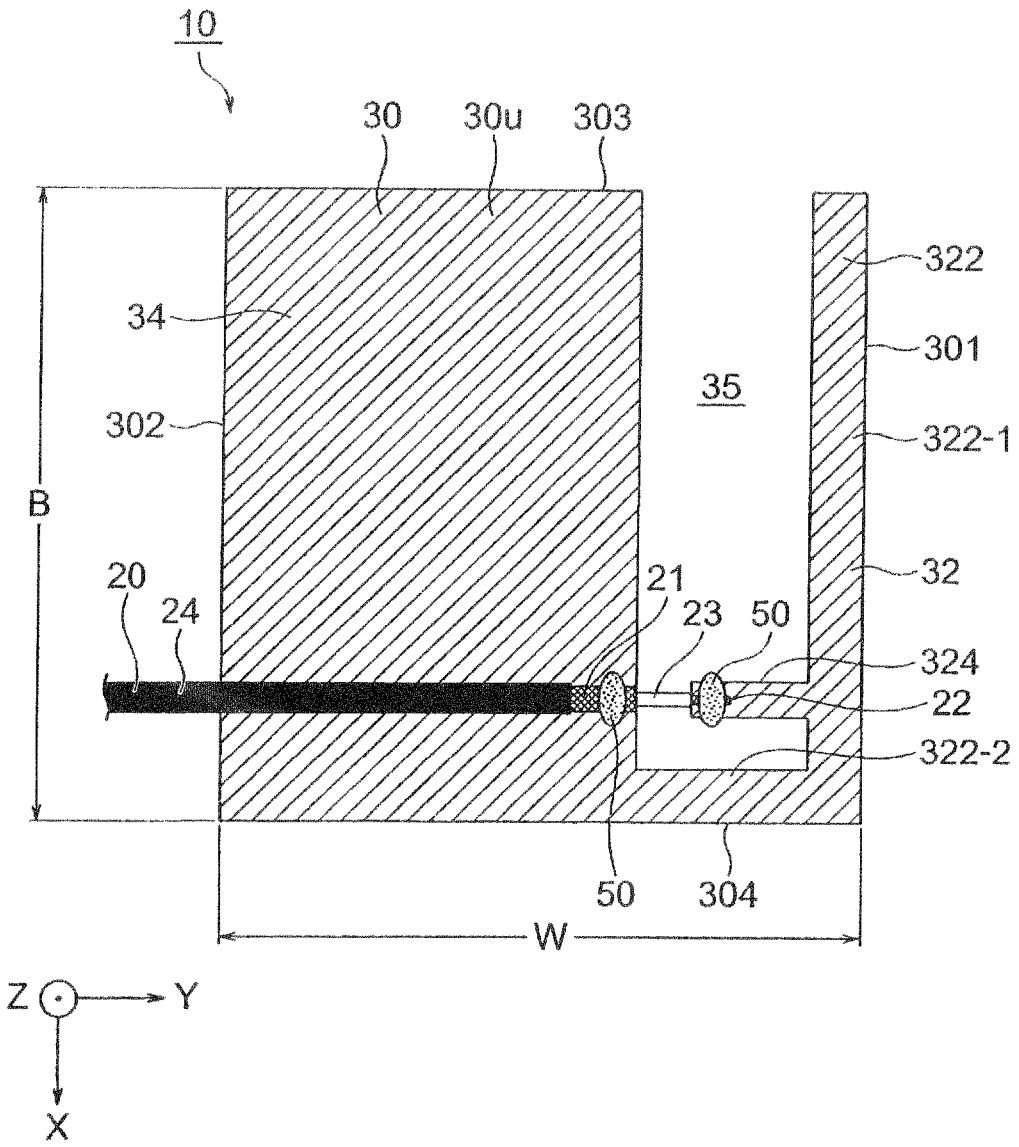
FIG. 1 RELATED ART
FIG. 1 is a plan view showing a related antenna device (sheet metal antenna)

FIG. 1 is a plan view showing a related antenna device 10. The related antenna device 10 illustrated in FIG. 1 comprises a configuration which is substantially similar to an antenna device illustrated in the above-mentioned Patent Documents 2 and 3. The related antenna device 10 illustrated in FIG. 1 comprises a sheet metal antenna.

In FIG. 1, a Cartesian coordinate system (X, Y, Z) is adopted. In a state illustrated in FIG. 1, an X-axis direction is a fore-and-aft direction (a depth direction), a Y-axis direction is a left-and-right direction (a width direction, a lateral direction), and a Z-axis direction is an up-and-down direction (a height direction).

The illustrated antenna device (sheet metal antenna) 10 is for transmitting and receiving a radio wave having a predetermined frequency band. In the example being illustrated, the predetermined frequency band is a frequency of 2.4 GHz band which is used in IEEE 802.11b/g.

The illustrated antenna device (sheet metal antenna) 10 comprises a coaxial cable 20 serving as a feeding line and an antenna element 30.

The coaxial cable 20 is an electric-signal transmission medium having a coaxial form, which includes a cylindrical outer conductor 21 and a central conductor 22 which is lines in a center thereof. The outer conductor 21 and the central conductor 22 are insulated by a cylindrical insulator 23. In addition, the outer conductor 21 is covered with a sheath 24. The outer conductor 21 is also called an earth line or an external conductor and is made up of a meshed conducting wire. The central conductor 22 is also called a core wire or an internal conductor. In addition, the central conductor 22 is also referred to as a first conductor while the outer conductor 21 is also referred to as a second conductor.

In the example being illustrated, the coaxial cable 20 has a diameter of 0.8 mm. Further, the outer conductor 21 has an outer diameter of 0.6 mm.

As shown in FIG. 1, the illustrated coaxial cable 20 extends in the left-and-right direction (the Y-axis direction). The coaxial cable 20 has a tip portion which is cut. The central conductor 22, the insulator 23, and the outer conductor 21 are exposed from the tip portion of the coaxial cable 20.

The antenna element 30 is made by pressing a plat-plate-like metallic plate (a rectangular conductive flat plate) having a principle surface (a main surface or an upper surface) 30*u*. The metallic plate (the rectangular conductive flat plate) before pressing has a substantially rectangular parallelepiped (rectangular plate) shape having a length (a longitudinal length) B, a width (a lateral length) W, and a thickness (a height) T (which is not shown in FIG. 1). In the example being illustrated, the length (the longitudinal length) B is equal to 22 mm, the width (the lateral length) W is equal to 24 mm, and the thickness (the height) T is equal to 0.15 mm. In addition, the example being illustrated, the metallic plate (the rectangular conductive flat plate) is formed from phosphor bronze that is not plated.

In other words, the antenna element 30 has a structure where a slit 35 is formed in the metallic plate serving as the rectangular conductive flat plate. The rectangular conductive flat plate (the metallic plate) has four sides (a right side 301, a left side 302, a rear side 303, and a front side 304). Herein, the right side 301 is also called a first side, the left side 302 is also called a second side, the rear side 303 is also called a third side, and the front side 304 is also called a fourth side. The first side (the right side) 301 and the second side (the left side) 302 are opposite to each other and extend in the fore-and-aft direction (the X-axis direction). The third side (the rear side) 303 and the fourth side (the front side) 304 are opposite to each other and extend in the left-and-right direction (the Y-axis direction).

The antenna element 30 is divided into an antenna pattern portion 32 and a ground pattern portion 34 via the slit 35. The antenna pattern portion 32 is also called a radiating element portion while the ground pattern portion 34 is also called a ground portion.

On the principle surface (the main surface of the upper surface) 30*u* of the flat-shaped metallic plate (the rectangular conductive flat plate), the coaxial cable (the feeding line) 30 is disposed.

As shown in FIG. 1, the antenna pattern portion 32 is formed at a side of the first side (the right side) 301 while the ground pattern portion 34 is formed at a side of the second side (the left side) 302. In the example being illustrated, the antenna pattern portion 32 comprises an inverted-F antenna. The inverted-F antenna 32 comprises an L-type part 322 shaped like a letter L and a power feed part 324 extending from the L-type part 322. The L-type part 322 has a long side part 322-1 extending along the first side (the right side) 301 in the fore-and-aft direction (the X-axis direction) and a short side part 322-2 extending in the lateral direction (the Y-axis direction). The ground pattern portion 34 has a substantially rectangular shape.

The central conductor (the first conductor) 22 of the coaxial cable 20 is electrically connected to the power feed part 324 of the antenna pattern portion (the inverted-F antenna) 32 by means of soldering of a solder 50. The outer conductor (the second conductor) 21 of the coaxial cable 20 is electrically connected to the ground pattern portion 34 by means of soldering of a solder 50.

As shown in FIG. 1, the coaxial cable 20 extends, on the ground pattern portion 34, in parallel with a direction (the Y-axis direction) orthogonal to a longitudinal direction (the X-axis direction) of the antenna pattern portion (the inverted-F antenna) 32 and along the fourth side 304 in proximity to one side (the fourth side) 304 of the ground pattern portion 34.

However, in the manner which will become clear as the description proceeds, the antenna device 10 configured with such as an inverted-F antenna 32 is disadvantageous in that a frequency band of a transmittable/receivable radio wave (radio signal) is narrow and radiation efficiency is not excellent, as mentioned in the preamble of the instant specification.

Referring now figures, the description will proceed to exemplary embodiments of the present invention in more detail.

First Exemplary Embodiment

Figure 2:
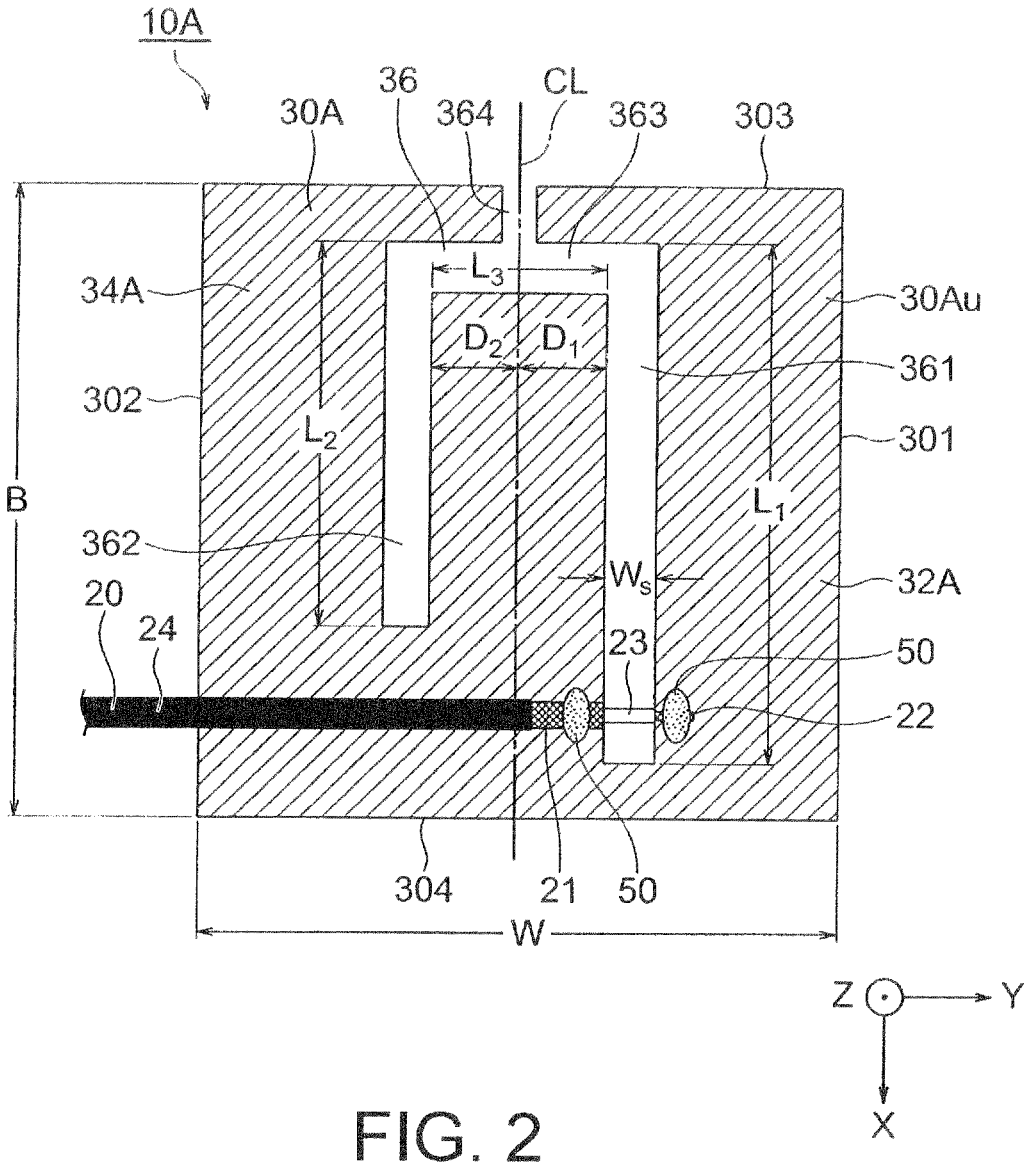
FIG. 2 is a plan view showing an antenna device (sheet metal antenna) according to a first exemplary embodiment of this invention.

Referring to FIG. 2, the description will proceed to an antenna device (a sheet metal antenna) 10A according to a first exemplary embodiment of this invention. FIG. 2 is a plan view showing the antenna device (the sheet metal antenna) 10.

In FIG. 2, a Cartesian coordinate system (X, Y, Z) is adopted. In a state illustrated in FIG. 2, an X-axis direction is a fore-and-aft direction (a depth direction), a Y-axis direction is a left-and-right direction (a width direction, a lateral direction), and a Z-axis direction is an up-and-down direction (a height direction).

The illustrated antenna device 10A is similar in structure to the related antenna device 10 illustrated in FIG. 1 except that a shape of the slit formed in the metallic plate (the rectangular conductive flat plate) is different from that illustrated in FIG. 1 as will later become clear. In other words, the illustrated antenna unit 10A is similar in structure to the related antenna device 10 illustrated in FIG. 1 except that a configuration of the antenna element is different from that illustrated in FIG. 1 as will later become clear. Accordingly, in the antenna device 10A, the antenna element is depicted at a reference sign of 30A and the slit is depicted at a reference sign of 36. Components having functions similar to those of the components shown in FIG. 1 are given the same reference signs. Detailed explanations are made solely about the differences for simplification of explanation.

The illustrated antenna device (sheet metal antenna) 10A is for transmitting and receiving a radio wave having a predetermined frequency band. In the example being illustrated, the predetermined frequency band is a frequency of 2.4 GHz band used for IEEE 802.11b/g.

As shown in FIG. 2, in the antenna device 10A, the illustrated slit 26 is formed in a central portion of the rectangular conductive flat plate (the metallic plate) and is substantially shaped like a letter U. The antenna element 30A is divided into an antenna pattern portion 32A and a ground pattern portion 34A via the slit 36.

The antenna element 30A is made by pressing flat-plate-like metallic plate (a rectangular conductive flat plate) having a principal surface (a main surface or an upper surface) 30Au. In the example being illustrated, the metallic plate (the rectangular conductive flat plate) is formed from phosphor bronze that is not plated.

Although phosphor bronze is used as a material of the metallic plate in the example being illustrated, the material of the metallic plate is not limited thereto.

In the manner which is described above, the rectangular conductive flat plate (the metallic plate) has the first side (the right side) 301 and the second side (the left side) 302 which are opposite to each other with a center line CL sandwiched therebetween and which extend in parallel with the center line CL in the fore-and-aft direction (the X-axis direction) and the third side (the rear side) 303 and the fourth side (the front side) 304 which extend in a direction (the Y-axis direction) orthogonal to the first and the second sides and which are opposite to each other. Throughout this specification, the fore-and-aft direction (the X-axis direction) is also called a predetermined direction. Accordingly, the center line CL extends in the predetermined direction.

More specifically, the illustrated slit 36 comprises a first slit portion 361, a second slit portion 362, a third slit portion 363, and a cutting portion 364. The first slit portion 361 is disposed so as to apart from the center line CL toward the first side (the right side) 301 by a first predetermined distance $D_1$. The second slit portion 362 is disposed so as to apart from the center line CL toward the second side (the left side) 302 by a predetermined second distance $D_2$. The third slit portion 362 couples the first slit portion 361 with the second slit portion 362. The cutting portion 364 couples the third slit portion 363 with the third side (the rear side) 303.

In the example being illustrated, the first and the second slit portions 361 and 362 extend in parallel with the center line CL in the fore-and-aft direction (the X-axis direction). The third slit portion 363 couples the first slit portion 361 with the second slit portion 362 at respective ends thereof at a side closed to the third side (the rear side) 303 and extends in a direction (the Y-axis direction) orthogonal to the predetermined direction in which the center line CL extends.

In the example being illustrated, the first predetermined distance $D_1$ is equal to 2.875 mm and the second predetermined distance $D_2$ is equal to 1.825 mm.

The antenna pattern portion (the radiation element portion) 32A is formed between the first slit portion 361 and the first side (the right side) 301. The ground pattern portion (the ground portion) 34A occupies the rectangular conductive flat plate (the metallic plate) other than the antenna pattern portion (the radiation element portion) 32A.

Each of the first through the third slit portions 361 to 363 has a slit width $W_S$. In addition, the first slit portion 361 has a first length $L_1$, the second slit portion 362 has a second length $L_2$ shorter than the first length $L_1$, and the third slit portion 363 has a third length $L_3$. The cutting portion 364 is formed on the center line CL. In the example being illustrated, the slit width $W_S$ is equal to 1.5 mm, the first length $L_1$ is equal to 14 mm, the second length $L_2$ is equal to 12.4 mm, and the third length $L_3$ is equal to 4.7 mm.

Herein, it is assumed that a resonance wavelength, which is the reciprocal of the predetermined frequency, is represented by $\lambda$. In this event, a length $(L_1+L_2+L_3)$ of the U-shaped slit 36 comprising the first through the third slit portions 361 to 363 is substantially equal to $\lambda/2$.

Although the second length $L_2$ of the second slit portion 362 is shorter than the first length $L_1$ of the first slit portion 361 in the example being illustrated ($L_2<L_1$), this invention is, of course, not limited thereto. That is to say, the second length $L_2$ of the second slit portion 362 may be equal to the first length $L_1$ of the first slit portion 361 ($L_2=L_1$) or may be longer than that ($L_2>L_1$). In other words, a total length ($L_1+L_2+L_3$) of the U-shaped slit 36 may be substantially equal to $\lambda/2$ in the manner which is mentioned above.

The coaxial cable 20 extends between the fourth side (the front side) 304 and an end portion of the second slit portion 362. In the example being illustrated, the coaxial cable 20 extends in parallel with along the fourth side (the front side) 304 in proximity to the fourth side (the front side) 304 and at a position which do not cross the second slit portion 362. The central conductor (the first conductor) 22 of the coaxial cable 20 is electrically connected to the antenna pattern portion 32A by means of soldering a solder 50. The outer conductor (the second conductor) 21 of the coaxial cable 20 is electrically connected to the ground pattern portion 34A by means of soldering a solder 50.

In addition, in the manner which is described above, the length ($L_1+L_2+L_3$) of the first through the third slit portions 361 to 363 is set so as to be substantially equal to $\lambda/2$. However, in order to make impedance for power feeding match to 50Ω, adjustment is provided to the U-shaped slit 36 as follows. For example, a position of the cutting portion 364 is adjusted from side to side or the second length $L_2$ of the second slit portion 362 is adjusted.

As apparent from the above-description, the illustrated antenna element 32A serves as a dipole slit antenna.

While the antenna pattern portion (the inverted-F antenna) 32 of the antenna element 30 illustrated in FIG. 1 has a narrow width, the antenna pattern (the dipole slit antenna) 32A of the antenna element 30A illustrated in FIG. 2 has a wide width.

Figures 3, 4:
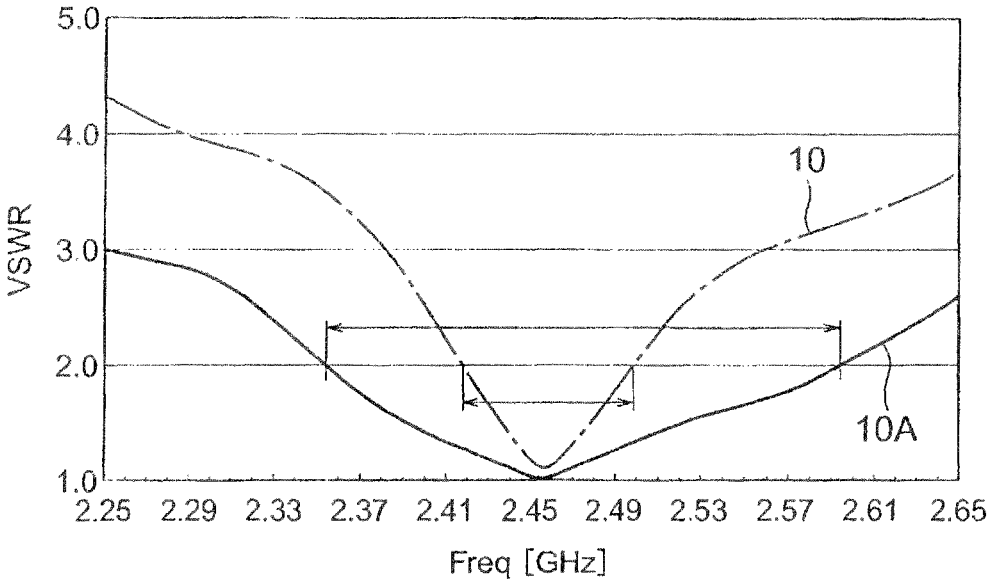
FIG. 3 is a view showing characteristics of voltage standing wave ratios (VSWRs) of the related antenna device (sheet metal antenna) illustrated in FIG. 1 and of the antenna device (sheet metal antenna) according to the first exemplary embodiment of this invention illustrated in FIG. 2.
FIG. 4 is a table showing radiation efficiency of the related antenna device (sheet metal antenna) illustrated in FIG. 1 and of the antenna device (sheet metal antenna) according to the first exemplary embodiment of this invention illustrated in FIG. 2.

FIG. 3 shows characteristics of voltage standing wave ratios (VSWRs) of the related antenna device (sheet metal antenna) illustrated in FIG. 1 and of the antenna device (sheet metal antenna) according to the first exemplary embodiment of this invention illustrated in FIG. 2. In FIG. 3, the abscissa represents a frequency [GHz] and the ordinate represents the VSWR. In FIG. 3, a solid line shows the characteristic of the VSWR of the antenna device (sheet metal antenna) 10A according to the first exemplary embodiment of this invention while an alternate long and short dashed line shows the characteristic of the VSWR of the related antenna device (sheet metal antenna) 10.

As apparent from FIG. 3, it is seen that the antenna device (sheet metal antenna) 10A illustrated in FIG. 2 has a wider frequency range where the VSWR is two or less in comparison with the related antenna device (sheet metal antenna) 10 illustrated in FIG. 1. As described above, it is possible for the antenna device (sheet metal antenna) 10A illustrated in FIG. 2 to expand a transmittable/receivable predetermined frequency band in contradistinction to the related antenna device (sheet metal antenna) 10 illustrated in FIG. 1. As a result, on producing the antenna devices (sheet metal antennas) 10A in quantity, it is possible to prove no problem although there is a frequency drift more or less. As a consequence of this, it is possible to improve yields in volume production.

FIG. 4 is a table showing radiation efficiency of the related antenna device (sheet metal antenna) 10 illustrated in FIG. 1 and of the antenna device (sheet metal antenna) 10A according to the first exemplary embodiment of this invention illustrated in FIG. 2

As apparent from FIG. 4, it is seen that the radiation efficiency is improved in the antenna device (sheet metal antenna) 10A illustrated in FIG. 2 in contradistinction to the related antenna device (sheet metal antenna) 10 illustrated in FIG. 1.

Now, the description will be made as regards effects of the antenna device (sheet metal antenna) 10A according to the first exemplary embodiment.

A first effect is that it is possible to expand the transmittable/receivable frequency band of the antenna device (sheet metal antenna) 10A as compared with the related antenna device (sheet metal antenna) 10 configured with the inverted-F antenna. This is because the antenna device (sheet metal antenna) 10A comprises the antenna pattern portion 32A having a width which is wider than that of the antenna pattern portion 32 of the related antenna device (sheet metal antenna) 10 and further comprises the second and the third slit portions 362 and 363.

A second effect is that it is possible to improve the radiation efficiency of the antenna device (sheet metal antenna) 10A as compared with the related antenna device (sheet metal antenna) 10 configured with the inverted-F antenna. This is because it is possible to improve an effective radiated area of the antenna device (sheet metal antenna) 10A.

Second Exemplary Embodiment

Figure 5:
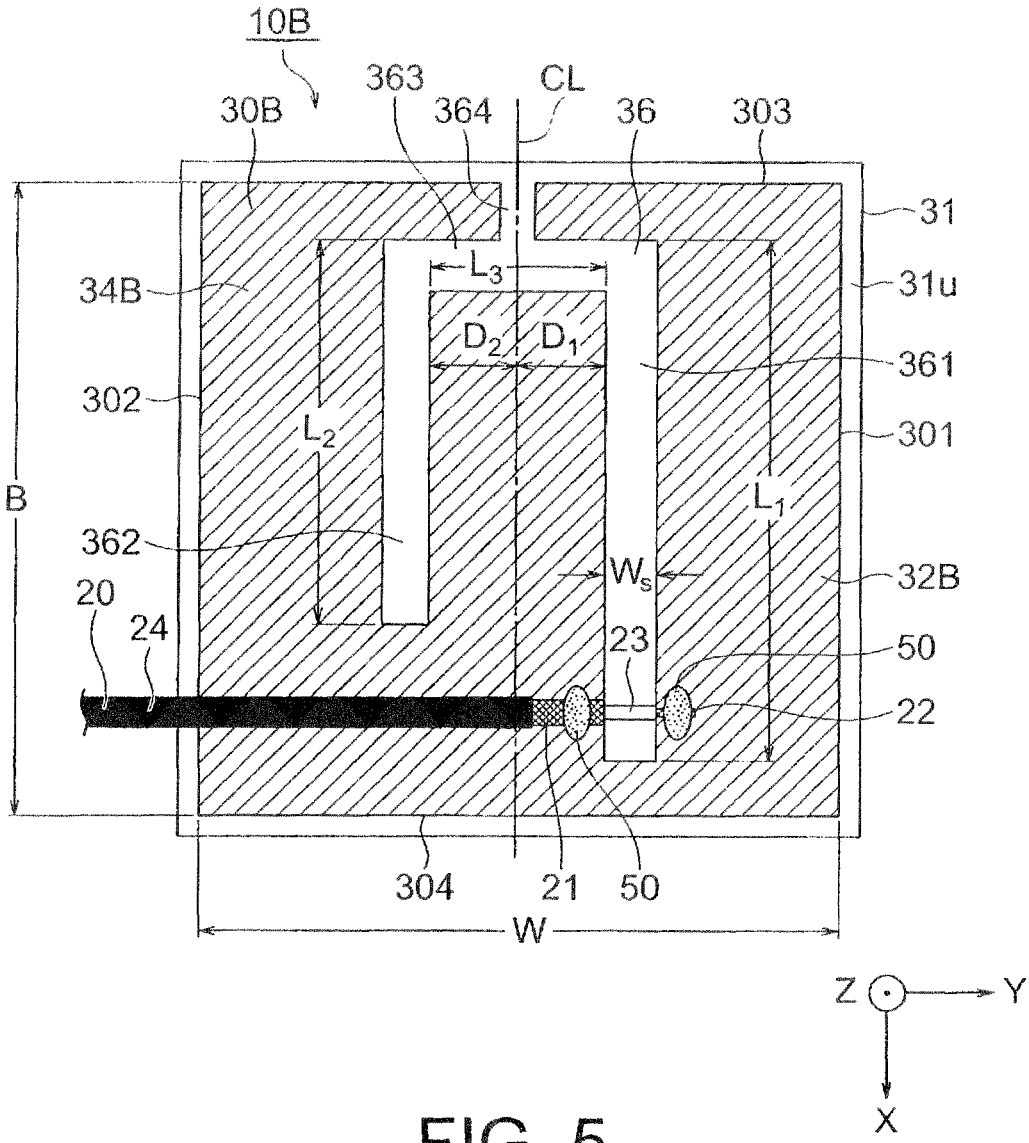
FIG. 5 is a plan view showing an antenna device (board antenna) according to a second exemplary embodiment of this invention.

Referring to FIG. 5, the description will proceed to an antenna device (a board antenna) 10B according to a second exemplary embodiment of this invention. FIG. 5 is a plan view showing the antenna device (the board antenna) 10B.

In FIG. 5, a Cartesian coordinate system (X, Y, Z) is adopted. In a state illustrated in FIG. 5, an X-axis direction is a fore-and-aft direction (a depth direction), a Y-axis direction is a left-and-right direction (a width direction, a lateral direction), and a Z-axis direction is an up-and-down direction (a height direction).

The illustrated antenna device 10B is similar in structure to the antenna device 10A illustrated in FIG. 2 except that a configuration of the antenna element is different from that illustrated in FIG. 2 as will later become clear. Accordingly, the antenna element is depicted at a reference sign of 30B. Components having functions similar to those of the components shown in FIG. 2 are given the same reference signs. Detailed explanations are made solely about the differences for simplification of explanation.

The illustrated antenna device (board antenna) 10B is for transmitting and receiving a radio wave having a predetermined frequency band. In the example being illustrated, the predetermined frequency band is a frequency of 2.4 GHz band used for IEEE 802.11b/g.

The antenna element 30B comprises a flat-shaped printed wiring board 31 having a principal surface (a main surface or an upper surface) 31*u*. The printed wiring board 31 has a shape of a rectangular plate.

The antenna element 30B comprises an antenna pattern portion 32B and a ground pattern portion 34B which are formed on the principal surface 31*u* of the printed wiring board 31. The antenna pattern portion 32B and the ground pattern portion 34B have shapes (outside shapes) and dimensions which are similar to those of the antenna pattern portion 32A and the ground pattern portion 34A illustrated in FIG. 2, respectively. Accordingly, the antenna pattern portion 32B and the ground pattern portion 34B are divided by the slit 36.

Inasmuch as the slit 36 has a shape (an outer shape) and a dimension which are similar to those of the slit 36 illustrated in FIG. 2, the detailed description thereof is omitted.

Accordingly, the illustrated antenna element 32B also serves as a dipole slit antenna in the manner similar to the above-mentioned antenna element 32A.

In addition, the antenna element 30B (the antenna pattern portion 32B and the ground pattern portion 34B) is covered with a resist film (not shown) formed over the principal surface 31*u* of the printed wiring board 31. The ground pattern portion 34B is formed integrally with the antenna pattern portion 32B. The antenna pattern portion 32B and the ground pattern portion 34B are made of copper foil.

Although the antenna pattern portion 32B and the ground pattern portion 34B are made of copper foil in the example being illustrated, they may be made of any of other conductor foils.

The antenna device (board antenna) 10B has a VSWR characteristic and a radiation characteristic which are similar to those of the antenna device (sheet metal antenna) 10A as shown in FIGS. 3 and 4.

Now, the description will be made as regards effects of the antenna device (board antenna) 10B according to the second exemplary embodiment.

A first effect is that it is possible to expand the transmittable/receivable frequency band of the antenna device (board antenna) 10B as compared with the related antenna device (sheet metal antenna) 10 configured with the inverted-F antenna. This is because the antenna device (board antenna) 10B comprises the antenna pattern portion 32B having a width which is wider than that of the antenna pattern portion 32 of the related antenna device (sheet metal antenna) 10 and further comprises the second and the third slit portions 362 and 363.

A second effect is that it is possible to improve the radiation efficiency of the antenna device (board antenna) 10B as compared with the related antenna device (sheet metal antenna) 10 configured with the inverted-F antenna. This is because it is possible to improve an effective radiated area of the antenna device (board antenna) 10B.

While the invention has been particularly shown and described with reference to exemplary embodiments thereof, the invention is not limited to these embodiments. It will be understood by those of ordinary skill in the art that various changes in form and details may be made therein without departing from the sprit and scope of the present invention as defined by the claims. For example, although the coaxial cable 20 is used as a feeding line in the above-mentioned exemplary embodiments, the feeding line is, of course, not limited thereto. In addition, although the antenna devices according to the above-mentioned exemplary embodiments use, as the conductive flat plate, the rectangular-shaped one, the conductive flat plate is, of course, not limited to the rectangular-shaped one. Furthermore, although an electrical connection between the outer conductor (the second conductor) 21 of the coaxial cable (the feeding line) 20 and the ground pattern portion 34A is performed by using the solder 50 in the above-mentioned first exemplary embodiment, the electrical connection may be, of course, performed by swaging at a swage portion, as disclosed in the above-mentioned Patent Document 2.

The whole or part of the exemplary embodiments disclosed above can be described as, but not limited to, the following supplementary notes.

(Supplementary Note 1)

An antenna device (10A; 10B) comprising:

a feeding line (20) including a first conductor (22) and a second conductor (21); and an antenna element (30A; 30B) comprising a conductive flat plate in which a slot (36) is formed, wherein said antenna element (30A; 30B) is divided into an antenna pattern portion (32A; 32B) and a ground pattern portion (34A; 34B) via said slit (36), wherein the first conductor (22) of said feeding line (20) is connected to said antenna pattern portion (32A; 32B), and the second conductor (21) of said feeding line (20) is connected to said ground pattern portion (34A; 34B), wherein said conductive flat plate has first and second sides (301, 302) opposite to each other in a state where a center line (CL) extending in a predetermined direction is sandwiched therebetween, and a third side (303) connecting the first and the second sides, wherein said slit (36) is configured with:

a first slit portion (361) disposed so as to apart from the center line (CL) toward the first side (301) by a first predetermined spacing ($D_1$);

a second slit portion (362) disposed so as to apart from the center line (CL) toward the second side (302) by a second predetermined spacing ($D_2$);

a third slit portion (363) coupling the first slit portion (361) with the second slit portion (362); and a cutting portion (364) coupling the third slit portion (363) with the third side (303).

(Supplementary Note 2)

The antenna device according to Supplementary note 1, wherein said conductive flat plate comprises a rectangular conductive flat plate, wherein said slit (36) is formed in a central portion of said rectangular conductor flat plate and comprises a substantially U-shaped slit, wherein the first and the second slit portions (361, 362) extend in parallel with the center line (CL), wherein the third slit (363) extends in a direction orthogonal to the predetermined direction.

(Supplementary Note 3)

The antenna device according to Supplementary note 2, wherein said antenna device has a predetermined frequency which is the reciprocal of a resonance wavelength of $\lambda$, wherein the substantially U-shaped slit (36) comprising the first through the third slit portions (361-362) has a length ($L_1+L_2+L_3$) which is substantially equal to $\lambda/2$.

(Supplementary Note 4)

The antenna device according to Supplementary note 1, wherein the cutting portion (364) is formed on the center line (CL).

(Supplementary Note 5)

The antenna device according to Supplementary note 1, wherein said conductive flat plate has a fourth side (304) opposite to the third side (303), wherein the first slit portion (361) has a first length ($L_1$), and the second slit portion (362) has a second length ($L_2$) shorter than the first length, wherein said feeding line comprises a coaxial cable (20) extending between the fourth side (304) and an end portion of the second slit portion (362), said coaxial cable (20) including a central conductor (22) as the first conductor and an outer conductor (21) as the second conductor.

(Supplementary Note 6)

The antenna device according to Supplementary note 1, wherein said antenna element (30A) is made of a metallic plate.

(Supplementary Note 7)

The antenna device according to Supplementary note 1, wherein said antenna element (30B) comprises a board (31) having a principal surface (31*u*), wherein said antenna pattern portion (32B) and said ground pattern portion (34B) are formed of conductor foil laid on the principal surface (31*u*) of the board (31).

In this connection, inasmuch as reference symbols in parentheses are attached in order to facilitate an understanding of this invention and are merely one example thereof, this invention is, of course, not limited to them.

What is claimed is:

1. An antenna device comprising:

a feeding line including a first conductor and a second conductor; and an antenna element comprising a conductive flat plate in which a slot is formed, wherein said antenna element is divided into an antenna pattern portion and a ground pattern portion via said slit, wherein the first conductor of said feeding line is connected to said antenna pattern portion, and the second conductor of said feeding line is connected to said ground pattern portion, wherein said conductive flat plate has first and second sides opposite to each other in a state where a center line extending in a predetermined direction is sandwiched therebetween, and a third side connecting the first and the second sides, wherein said slit is configured with:

a first slit portion disposed so as to apart from the center line toward the first side by a first predetermined spacing;

a second slit portion disposed so as to apart from the center line toward the second side by a second predetermined spacing;

a third slit portion coupling the first slit portion with the second slit portion; and a cutting portion coupling the third slit portion with the third side.

2. The antenna device as claimed in claim 1, wherein said conductive flat plate comprises a rectangular conductive flat plate, wherein said slit is formed in a central portion of said rectangular conductor flat plate and comprises a substantially U-shaped slit, wherein the first and the second slit portions extend in parallel with the center line, wherein the third slit extends in a direction orthogonal to the predetermined direction.

3. The antenna device as claimed in claim 2, wherein said antenna device has a predetermined frequency which is the reciprocal of a resonance wavelength of $\lambda$, wherein the substantially U-shaped slit comprising the first through the third slit portions has a length which is substantially equal to $\lambda/2$.

4. The antenna device as claimed in claim 1, wherein the cutting portion is formed on the center line.

5. The antenna device as claimed in claim 1, wherein said conductive flat plate has a fourth side opposite to the third side, wherein the first slit portion has a first length, and the second slit portion has a second length shorter than the first length, wherein said feeding line comprises a coaxial cable extending between the fourth side and an end portion of the second slit portion, said coaxial cable including a central conductor as the first conductor and an outer conductor as the second conductor.

6. The antenna device as claimed in claim 1, wherein said antenna element is made of a metallic plate.

7. The antenna device as claimed in claim 1, wherein said antenna element comprises a board having a principal surface, wherein said antenna pattern portion and said ground pattern portion are formed of conductor foil laid on the principal surface of the board.

* * * * *